United States Patent [19]

Johnson

[11] Patent Number: 4,580,777

[45] Date of Patent: Apr. 8, 1986

[54] EXERCISE WALKWAY

[76] Inventor: Darrell M. Johnson, 318 Jackson St., Thomson, Ga. 30824

[21] Appl. No.: 623,653

[22] Filed: Jun. 22, 1984

[51] Int. Cl.[4] ..... A63B 23/04

[52] U.S. Cl. ..... 272/70; 272/113; D25/63; 182/118; 119/29; 52/182; D21/245

[58] Field of Search ..... 272/113, 70, 93, 109, 272/69, 97; D21/245; D25/62, 63, 69; 52/182, 184, 188; 182/106, 113, 115, 118, 194; 119/29, 82, 185

[56] References Cited

U.S. PATENT DOCUMENTS

| | | | |
|---|---|---|---|
| 71,049 | 11/1867 | Page | 52/182 |
| D. 214,264 | 5/1969 | Holbrook | D25/63 |
| 678,695 | 7/1901 | Schoenhut | 182/118 |
| 821,391 | 5/1906 | Wiltse | 272/113 |
| 2,871,914 | 2/1959 | Timoney | 182/106 X |
| 3,035,671 | 5/1962 | Sicherman | 272/70 X |
| 3,311,996 | 4/1967 | Bergener | 52/182 X |
| 4,004,652 | 1/1977 | Laboy-Alvarado | 182/118 |

FOREIGN PATENT DOCUMENTS

| | | | |
|---|---|---|---|
| 730678 | 5/1932 | France | 52/182 |
| 78054 | 10/1918 | Switzerland | 52/182 |
| 11718 | of 1899 | United Kingdom | 52/182 |

*Primary Examiner*—Richard J. Apley
*Assistant Examiner*—David J. Brown
*Attorney, Agent, or Firm*—Dowell & Dowell

[57] ABSTRACT

An exercise walkway has a pair of aligned stairways that are arranged end to end and have a horizontal section therebetween so that a person may walk up one and down the other. Each stairway has a central handrail and the stairs on either side of it are of differing height and length so that a user may select which side he wishes to use of the walkway.

5 Claims, 7 Drawing Figures

EXERCISE WALKWAY

BACKGROUND OF THE INVENTION

The exercise of walking is recognized as an aid to health. Among the elderly and the infirm it is sometimes the only exercise that can be easily engaged in. While walking on a level is helpful additional benefits are obtained if the user walks on an inclined surface or up and down stairs. However, many stairs are overly taxing for the aged and those suffering from heart problems.

Furthermore, in many areas the prospect of walking away from the area may cause concern for one's welfare.

1. Field of the Invention

The invention is in the field of exercising devices particularly those for the relatively aged or infirm in which moderate walking exercise is desired.

2. Description of the Prior Art

Various devices for simulating walking are known. These include a baby stair trainer as disclosed in Timoney U.S. Pat. No. 2,871,914. A cross-country skiing simulating exerciser is disclosed in Norton U.S. Pat. No. 4,434,981.

A demountable stairway unit is disclosed in Gnehm U.S. Pat. No. 3,307,653.

SUMMARY OF THE INVENTION

The present invention is embodied in a low angled ramp having steps along the length thereof and with a central handrail. The steps on each side are of different lengths and have a small rise so that the elderly and infirm can use them without great difficult, and can select which of the sets of steps it desires to use. The steps have concrete treads in order to present the solid feel of walking on a concrete walk.

A user may select which side of the steps to ascent and cross-over a horizontal connecting walkway and then descend down the opposite ramp on steps having the same length and height on those on which he or she ascended.

Since the ramps are of a small angle an assistant may walk alongside to help the user if desired.

DESCRIPTION OF THE PREFERRED EMBODIMENT

Figure 1:
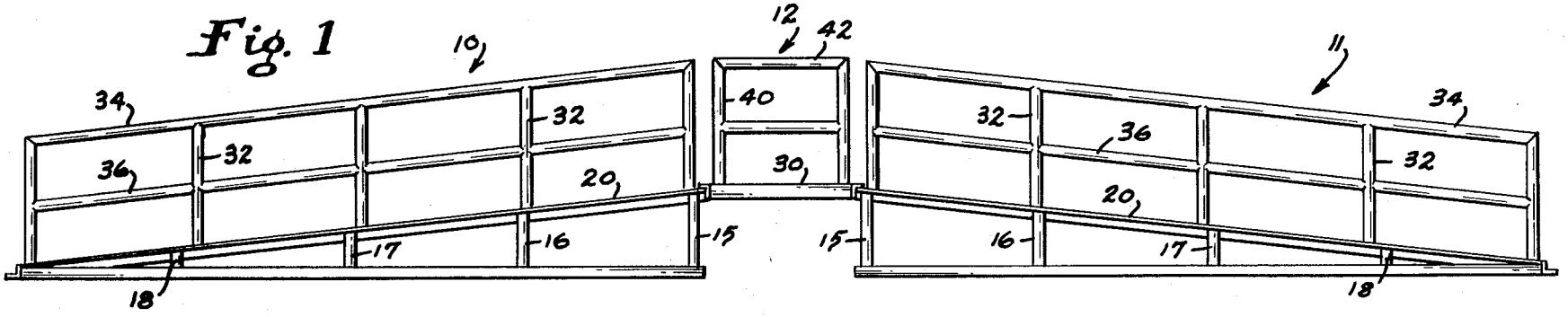
FIG. 1 is a side elevation of the device constructed in accordance with the invention.

With further reference to the drawings first and second aligned stairways 10 and 11 are connected by a horizontal walkway 12. The aligned stairways are of essentially identical construction. Each one includes a pair or parallel base members 14 from which a series of upstanding columns 15, 16, 17, and 18 extend, the columns being of different heights in order to support the series of step members. At the tops of each the columns parallel inclined angle iron members 20 are supported.

The step members include base treads 22 and risers 24 which are connected thereto and which extend between the side angle members 20. On the inward sides of the step members a central channel iron member 25 is connected to the base tread and riser members, as more particularly indicated in FIG. 5 of the drawing.

At the outward end of the uppermost step a channel member 27 is connected to a second channel member 28 on which is mounted the horizontal walkway tread 30.

A central hand support is formed along the stairways by a series of posts 32 on which is mounted the central hand rail 34. Middle rails 36 are also used to connect the central portions of the posts.

The horizontal walkway has upstanding posts 40 which mount the rail 42 at each side of the horizontal walkway.

Figure 3:
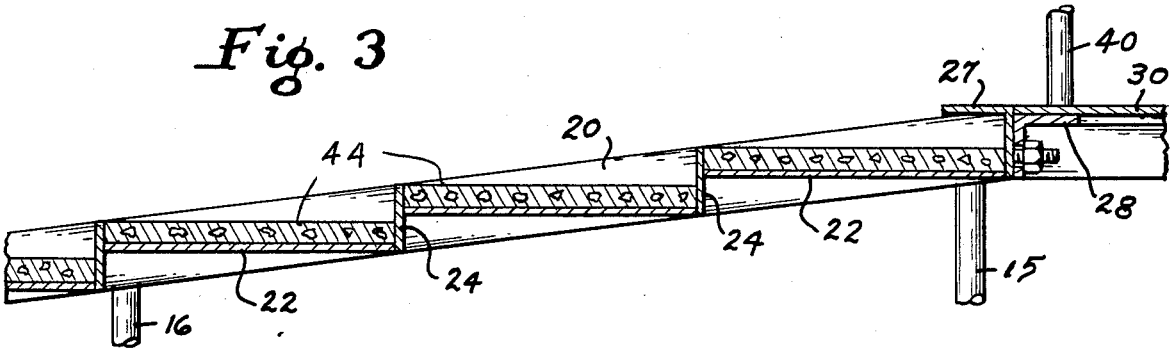
FIGS. 3, 4, and 5 are enlarged sections on the lines 3—3, 4—4, and 5—5 respectively of FIG. 2.
Figure 4:
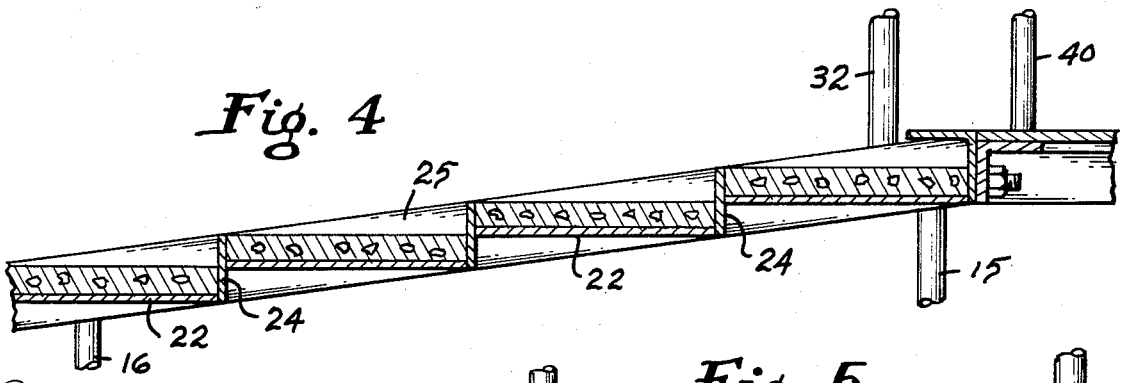
Figure 5:
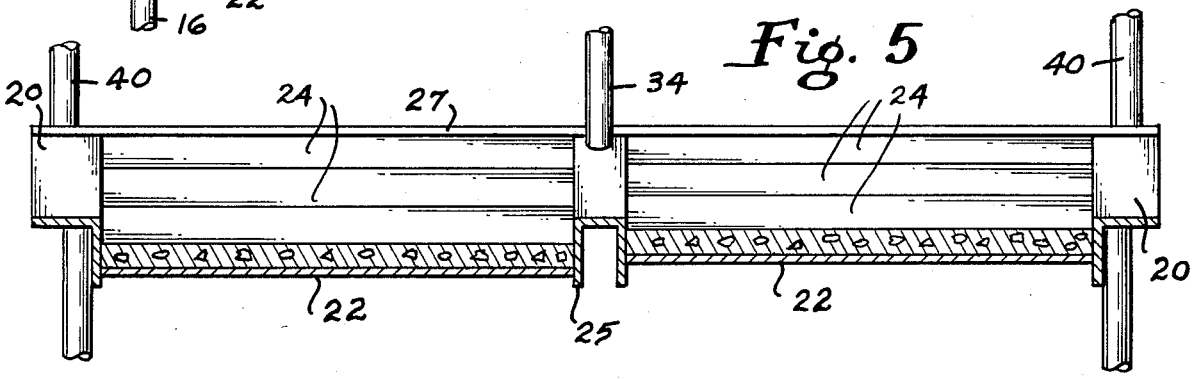

As indicated in FIGS. 3, 4, and 5 the base treads have risers which extend above the level of the upper base tread and thereby provide pockets in which concrete treads 44 may be poured in situ, such concrete treads providing the user with the feel of a concrete walkway in order to impart a feeling of confidence to the user. Alternately, preformed treads may be placed in the pockets.

Figure 2:
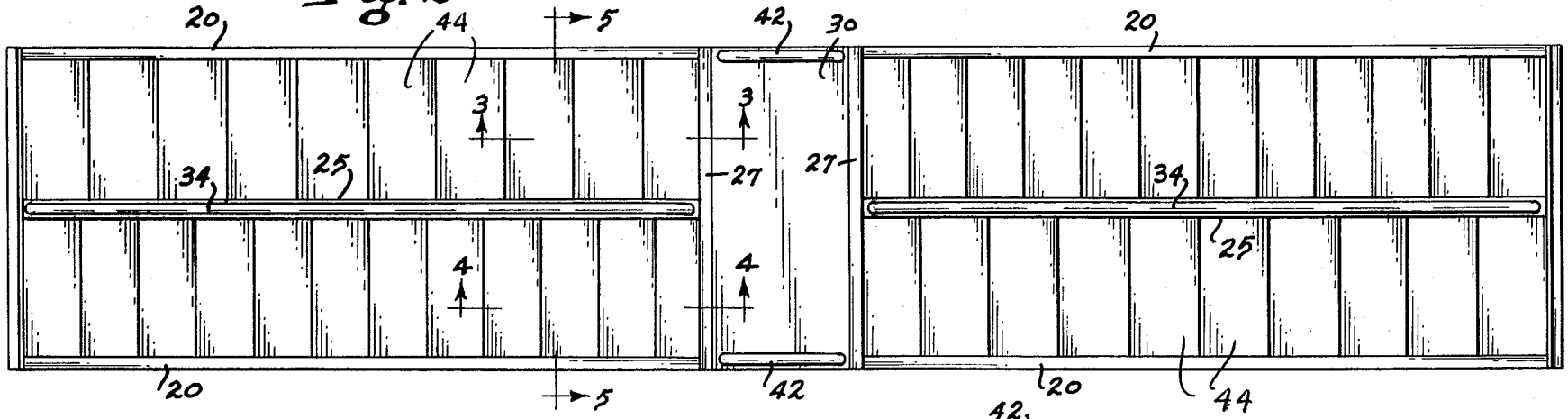
FIG. 2 is a plan view.

As indicated in the drawings the stairs along each side of the walkway are of different lengths and heights. Thus, as indicated, a user ascending the walkway on the right-hand stairs of FIG. 2 from left to right would walk on stairs that are of slightly shorter length than those on the left-hand side. Similarly, since these stairs are shorter and there are more of them, the rise of such stairs would be less than for those on the left-hand side. When the user arrives at the horizontal walkway he may if he desires continue his walk downwardly on stairs of the same length and height by merely walking across the walkway and descending the stairs on his left-hand side.

Since the ramp is of relatively low height an assistant may walk alongside the user to assist the user. Furthermore, it is preferred that the dimensions of each of the treads be such as to permit the user to employ a walker if desired.

By permitting the user to select which stairs he will ascend and descend any by permitting the user to continue going forward in the same direction in his descent the monotony of climbing and descending stairs is reduced.

Figure 7:
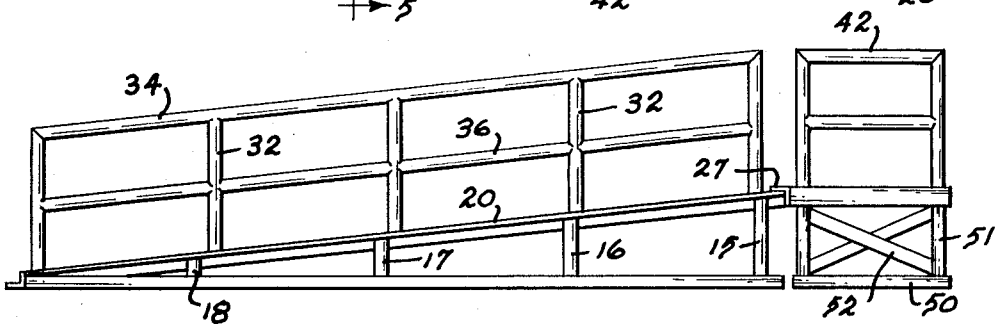
FIG. 7 is a side elevation of a modification.

However, if desired and in order to accommodate reduced space requirements, a single walkway may be employed as indicated in FIG. 7 in which case the horizontal walkway is self-supporting by supporting means including a base 50, columns 51, and cross members 52 as indicated in that drawing.

Figure 6:
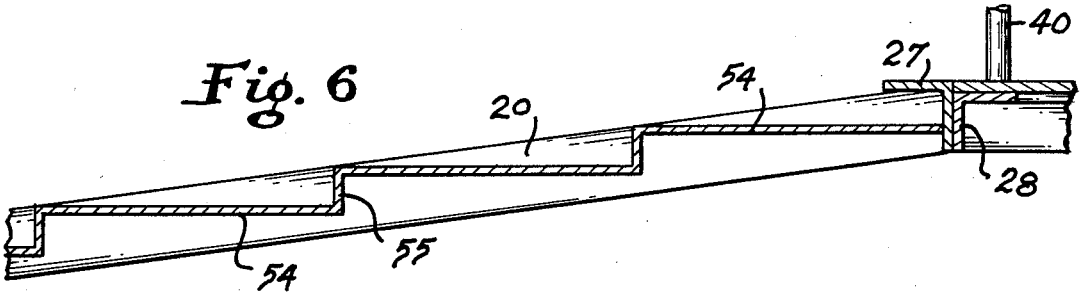
FIG. 6 is an enlarged section of a modified form of treads.

A further modification is indicated in FIG. 6 in which instead of using concrete treads the steps may be preformed metal providing integral treads 54 and risers 55.

I claim:

1. An exercise walkway, comprising first and second aligned stairways each rising from a first to a second level, a horizontal walkway connecting the second levels of the first and second stairways so that a user may ascend a first stairway and descend the second by using the connecting walkway, a central handrail extending longitudinally and medially of each stairway, a handrail along each side of said horizontal walkway, the stairs of each stairway on one side of the central handrail having a first uniform length and height, the stairs of each stairway on the other side of the central handrail having a substantially different length and a height than the stairs on said one side of the central handrail.

2. The invention of claim 1 in which the first and second stairways have stairs of corresponding length and height on corresponding sides of the central handrail, whereby a user may ascend a first stairway on one side and crossover at the horizontal walkway and descend the second stairway on its one side having stairs of the same length and depth as those which the user ascended, or may ascend a first stairway on its other side and descend the second stairway on its other side, or may ascend and descend on sides of different length or heights.

3. The invention of claim 1, in which the stairways are constructed of metal with risers separating the steps, and concrete treads are formed in situ between the risers.

4. The invention of claim 1, in which the stairways are constructed of metal with risers separating the steps, and concrete treads are formed between the risers, such treads being separately preformed.

5. An exercise walkway comprising a stairway from a first to a second level, a horizontal walkway at the second level, a central handrail extending longitudinally and medially of the stairway, the stairs of each stairway on one side of the central handrail having a first uniform length and height, the stairs of each stairway on the other side of the central handrail having a substantially different length and a height than the stairs on said one side of the central handrail, so that a user may ascend the stairs on one or the other side and crossover on the horizontal walkway and descend on the other or the one one side.

* * * * *